US008878091B2

(12) United States Patent
Yuba et al.

(10) Patent No.: US 8,878,091 B2
(45) Date of Patent: Nov. 4, 2014

(54) SWITCH DEVICE AND CONNECTOR

(75) Inventors: Takashi Yuba, Tokyo (JP); Daiei Iwamoto, Tokyo (JP); SeungSeok Beak, Tokyo (JP); Koichi Kiryu, Nagano (JP); Akio Nakamura, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 216 days.

(21) Appl. No.: 13/541,821

(22) Filed: Jul. 5, 2012

(65) Prior Publication Data

US 2013/0037519 A1 Feb. 14, 2013

(30) Foreign Application Priority Data

Aug. 11, 2011 (JP) ..... 2011-176406

(51) Int. Cl.
*H01H 9/44* (2006.01)
*H01H 9/42* (2006.01)
*H01H 15/10* (2006.01)

(52) U.S. Cl.
CPC ..... *H01H 9/42* (2013.01); *H01H 15/10* (2013.01); *H01H 9/443* (2013.01)
USPC ..... 218/36; 335/132

(58) Field of Classification Search
USPC ..... 218/36; 335/132
See application file for complete search history.

(56) References Cited

U.S. PATENT DOCUMENTS 2,351,989 A * 6/1944 Marbury ..... 361/16
4,551,701 A * 11/1985 Ubukata et al. ..... 337/97
4,804,933 A * 2/1989 Becker et al. ..... 335/186
7,149,063 B2 12/2006 Bryan et al.
7,938,660 B1 5/2011 Beak et al.
2004/0051605 A1* 3/2004 Fasano ..... 335/35
2008/0073327 A1* 3/2008 Annis et al. ..... 218/36
2009/0102585 A1* 4/2009 Annis et al. ..... 335/132
2010/0315193 A1* 12/2010 Hori et al. ..... 337/326
2013/0154774 A1* 6/2013 Bhavaraju et al. ..... 335/127
2013/0335175 A1* 12/2013 Tachikawa et al. ..... 335/147

FOREIGN PATENT DOCUMENTS

CN 1910802 2/2007
CN 201515109 U 6/2010
CN 102064430 5/2011
JP 05-082208 4/1993
JP 2003-031301 1/2003

* cited by examiner

*Primary Examiner* — Truc Nguyen
(74) *Attorney, Agent, or Firm* — IPUSA, PLLC

(57) ABSTRACT

A switch device includes first and second contacting portions including first and fixed contacting portions and first and second movable contacting portions, respectively, the first fixed contacting portion and the second fixed contacting portion being configured to be electrically connected to one of a power source and an electronic device while the first movable contacting portion and the second movable contacting portion are configured to be electrically connected to the other of the power source and the electronic device; and first and second electric arc voltage suppression units configured to be electrically connected to the first and second fixed contacting portions and the first and second movable contacting portions for suppressing generation of electric arcs there between, respectively.

10 Claims, 16 Drawing Sheets

SWITCH DEVICE AND CONNECTOR

BACKGROUND OF THE INVENTION

1. Field of the Invention

The present invention relates to a switch device and a connector.

2. Description of the Related Art

Generally, an electrical or electronic device is driven by supplying electric power from a power source of the like. When supplying the electric power from the power source or the like, the electric power is supplied to the electrical or electronic device through connectors. The connectors for connecting the electrical or electronic device and the power source may be a combination of a jack type connector and a plug type connector configured to be fitted in the jack type connector, as described in Patent Documents 1, Patent Documents 2 and the like.

Recently, as a countermeasure for global warming or the like, supplying of electric power of a direct current with a high voltage has been considered even for the power transmission in a local area. By using the electric power of a direct current with a high voltage, the power loss at the conversion of the voltage, the power transmission or the like can be reduced and it is not necessary to use a heavy cable. Especially, as an information device such as a server or the like consumes a large amount of electric power, supplying of the electric power of a direct current with a high voltage is desirable for the information device.

However, if the voltage of the electric power supplied to the electrical or electronic device is high, the electric power may cause some effects on a human body, or some effects on an operation of electronic components.

When such electric power of a direct current with a high voltage is used for an information device such as a server or the like, it is necessary to provide connectors which are different from connectors used for a general-purpose commercial power source of an alternating current. Further, as the connectors may be handled by a human when installing or maintaining the device, it is necessary to care for the effects on the human body or the like as well.

Further, if the electric power supplied from the power source exceeds 100 V or is direct current with a high voltage, when a switch device is incorporated in a connector, a current commercially available switch cannot be used as it is. For example, when the electric power supplied from the power source is direct current with 400 V, it may not be safe to use a switch device, which is currently used for electric power of an alternating current with 100 V as safety and reliability are not ensured.

PATENT DOCUMENT

[Patent Document 1] Japanese Laid-open Patent Publication No. H05-82208

[Patent Document 2] Japanese Laid-open Patent Publication No. 2003-31301

SUMMARY OF THE INVENTION

According to an embodiment, there is provided a switch device including a first contacting portion including a first fixed contacting portion and a first movable contacting portion configured to contact the first fixed contacting portion; a second contacting portion including a second fixed contacting portion and a second movable contacting portion configured to contact the second fixed contacting portion, the first fixed contacting portion and the second fixed contacting portion being configured to be electrically connected to one of a power source and an electronic device while the first movable contacting portion and the second movable contacting portion are configured to be electrically connected to the other of the power source and the electronic device; a first electric arc voltage suppression unit configured to be electrically connected to the first fixed contacting portion and the first movable contacting portion for suppressing generation of an electric arc between the first fixed contacting portion and the first movable contacting portion; and a second electric arc voltage suppression unit configured to be electrically connected to the second fixed contacting portion and the second movable contacting portion for suppressing generation of an electric arc between the second fixed contacting portion and the second movable contacting portion.

According to another embodiment, there is provided a switch device including a first contacting portion including a first fixed contacting portion and a first movable contacting portion configured to contact the first fixed contacting portion; a second contacting portion including a second fixed contacting portion and a second movable contacting portion configured to contact the second fixed contacting portion, the first fixed contacting portion and the second fixed contacting portion being configured to be electrically connected to one of a power source and an electronic device while the first movable contacting portion and the second movable contacting portion are configured to be electrically connected to the other of the power source and the electronic device; and a counter-electromotive force suppression unit configured to be electrically connected to the electronic device in parallel for suppressing generation of counter-electromotive force by the electronic device when the electrical connection between the electronic device and the power supply is broken.

According to another embodiment, there is provided a connector for electrically connecting a power source and an electronic device, including the above switch device; and a first fitting terminal and a second fitting terminal to be fitted with terminals of another connector.

Note that also arbitrary combinations of the above-described constituents, and any exchanges of expressions in the present invention, made among method, device, system, and so forth, are valid as embodiments of the present invention.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
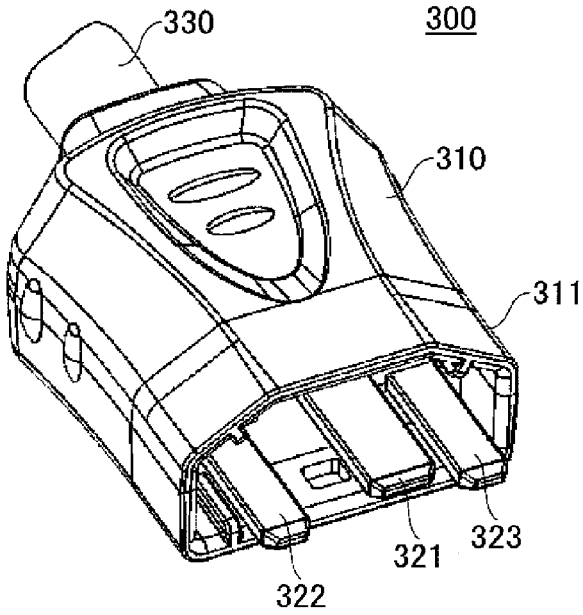
FIG. 1 is a perspective view of an example of a plug connector.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

A switch device and a connector of embodiments are configured to correspond to a high voltage. However, in the following embodiments, the expression "high voltage" does not mean a "direct current of over 750 V" which is defined by the electrical equipment technical standards or a "direct current of higher than or equal to 1500 V" which is an international standard defined by the International Electrotechnical Commission (IEC). Instead, the expression "high voltage" means a voltage that exceeds a safety extra low voltage (a direct current of less than 60 V). In other words, the "high voltage" in the following embodiments means a voltage higher than or equal to 60 V.

First Embodiment (Structure of Connector)

The structure of a connector of a first embodiment is explained.

Figure 4:
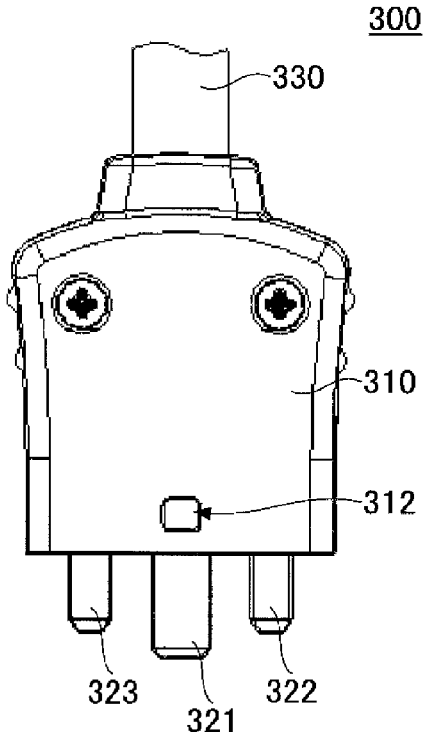
FIG. 4 is a bottom view of an example of the plug connector.
Figure 5:
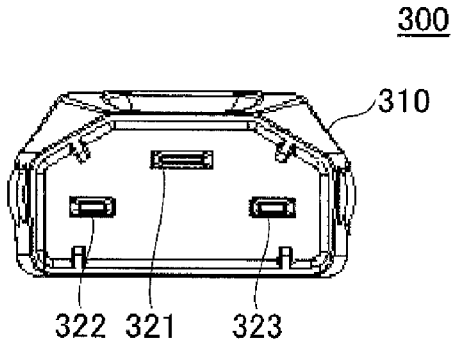
FIG. 5 is an elevation view of an example of the plug connector.
Figure 6:
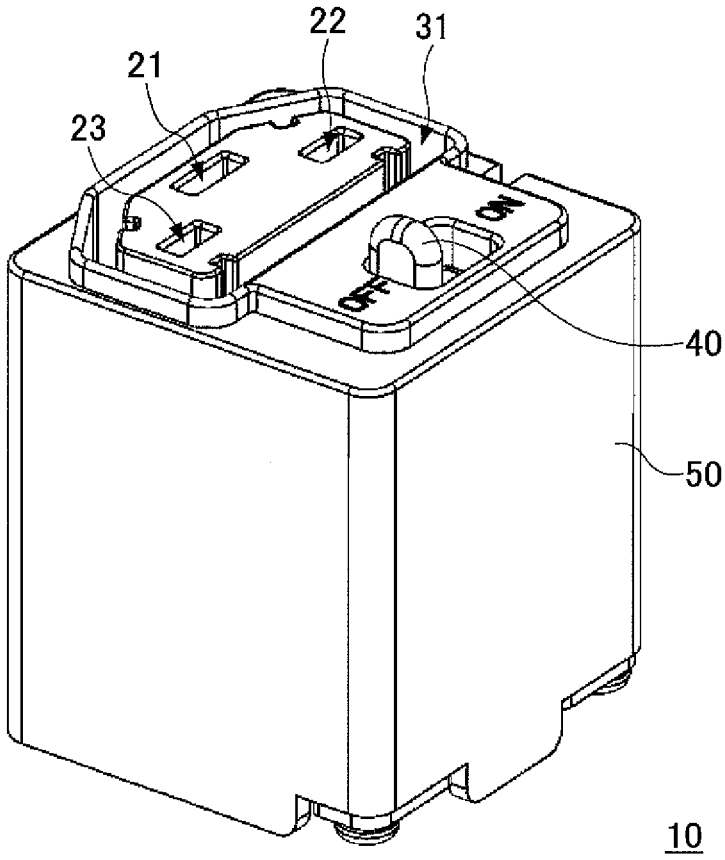
FIG. 6 is a perspective view of an example of a jack connector of a first embodiment.
Figure 7:
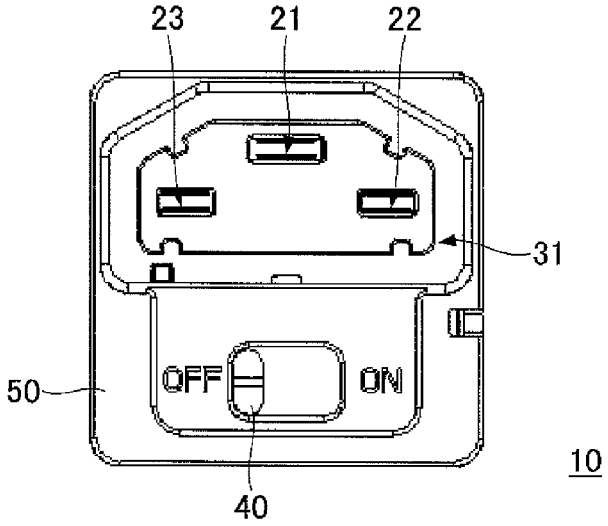
FIG. 7 is an elevation view of an example of the jack connector of the first embodiment.
Figure 8:
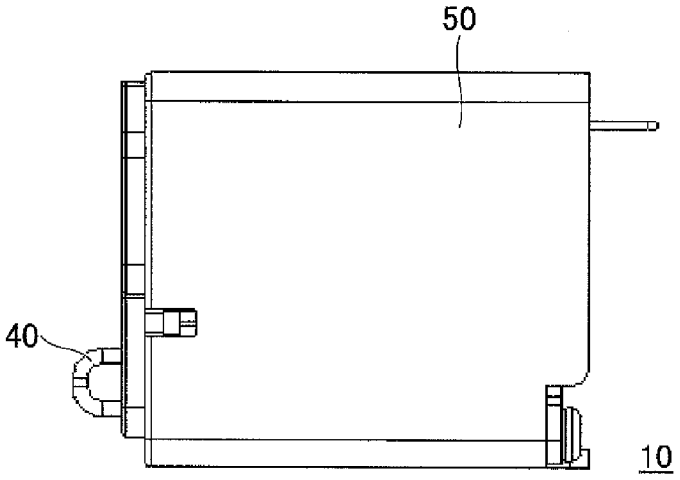
FIG. 8 is a side view of an example of the jack connector of the first embodiment.

The connector of the embodiment is a jack connector 10 shown in FIG. 6 to FIG. 8 which is to be connected to a plug connector 300 (which is an example of another connector) shown in FIG. 1 to FIG. 5. Hereinafter, a connected structure of the plug connector 300 and the jack connector 10 is referred to as a connector as well.

First, the structure of the plug connector 300 is explained with reference to FIG. 1 to FIG. 5.

Figure 2:
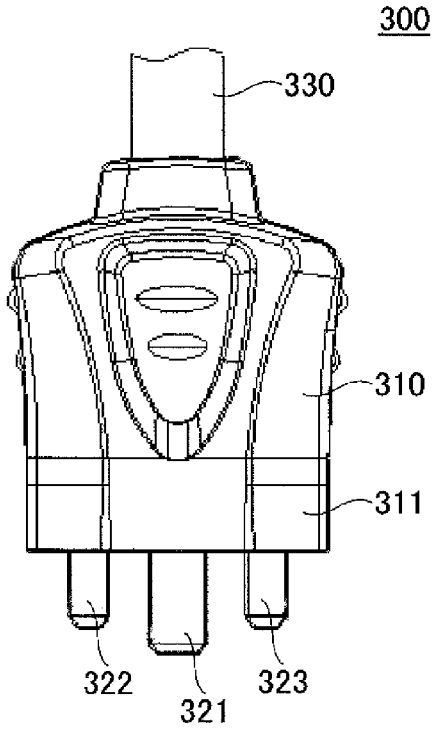
FIG. 2 is a top view of an example of the plug connector.
Figure 3:
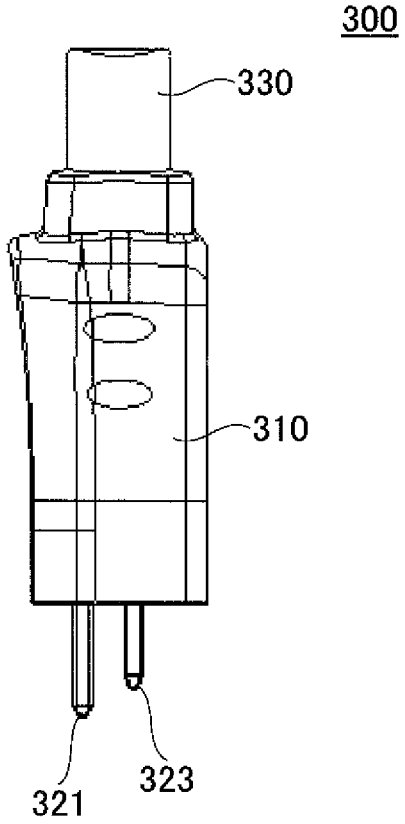
FIG. 3 is a side view of an example of the plug connector.

FIG. 1 is a perspective view of the plug connector 300, FIG. 2 is a top view of the plug connector 300, FIG. 3 is a side view of the plug connector 300, FIG. 4 is a bottom view of the plug connector 300, and FIG. 5 is an elevation view of the plug connector 300.

The plug connector 300 includes a cover 310, three plug terminals 321, 322 and 323, and a cable 330. Further, the cover 310 of the plug connector 300 is provided with a protection portion 311 and an opening 312 (see FIG. 4).

The cover 310 is made of an insulator or the like, for example. The plug terminals 321, 322 and 323 are provided at one side of the cover 310. The plug terminal 321 is a GND terminal and formed to be longer than the plug terminals 322 and 323. The plug terminals 322 and 323 (an example of terminals of the other connector) are configured to be electrically connected to terminals of the jack connector 10 so that electric power is supplied, as will be explained later.

The protection portion 311 is provided at the one side of the cover 310 to surround a part of the plug terminals 321, 322 and 323. The cable 330 is connected to the cover 310 at the other side of the cover 310. In this embodiment, the plug connector 300 is configured to be electrically connected to an electric device via the cable 330. The opening 312 is provided to fix the plug connector 300 with the jack connector 10 when the plug connector 300 is connected to the jack connector 10.

Next, the structure of the jack connector 10 of the embodiment is explained with reference to FIG. 6 to FIG. 8.

FIG. 6 is a perspective view of the jack connector 10, FIG. 7 is an elevation view of the jack connector 10 and FIG. 8 is a side view of the jack connector 10.

The jack connector 10 includes a housing 50 and an operation unit 40. Further, the jack connector 10 is provided with jack openings 21, 22 and 23 to which the plug terminals 321, 322 and 323 of the plug connector 300 are to be inserted, respectively, and a groove portion 31 to which the protection portion 311 of the plug connector 300 is to be inserted. The housing 50 covers the entirety of the jack connector 10. The jack openings 22 and 23 are an example of a first fitting terminal and a second fitting terminal. In this embodiment, as will be explained later, the jack connector 10 is configured to be electrically connected to a power source.

The operation unit 40 is provided to operate a switch device, which will be explained later, for controlling whether to supply electric power from the power source when the plug connector 300 and jack connector 10 are physically connected. The operation unit 40 is slidable between an "ON" position and an "OFF" position. By sliding the operation unit 40, the switch device is operated and whether to supply the electric power from the power source via the jack connector 10 to the plug connector 300 is controlled.

Figure 9:
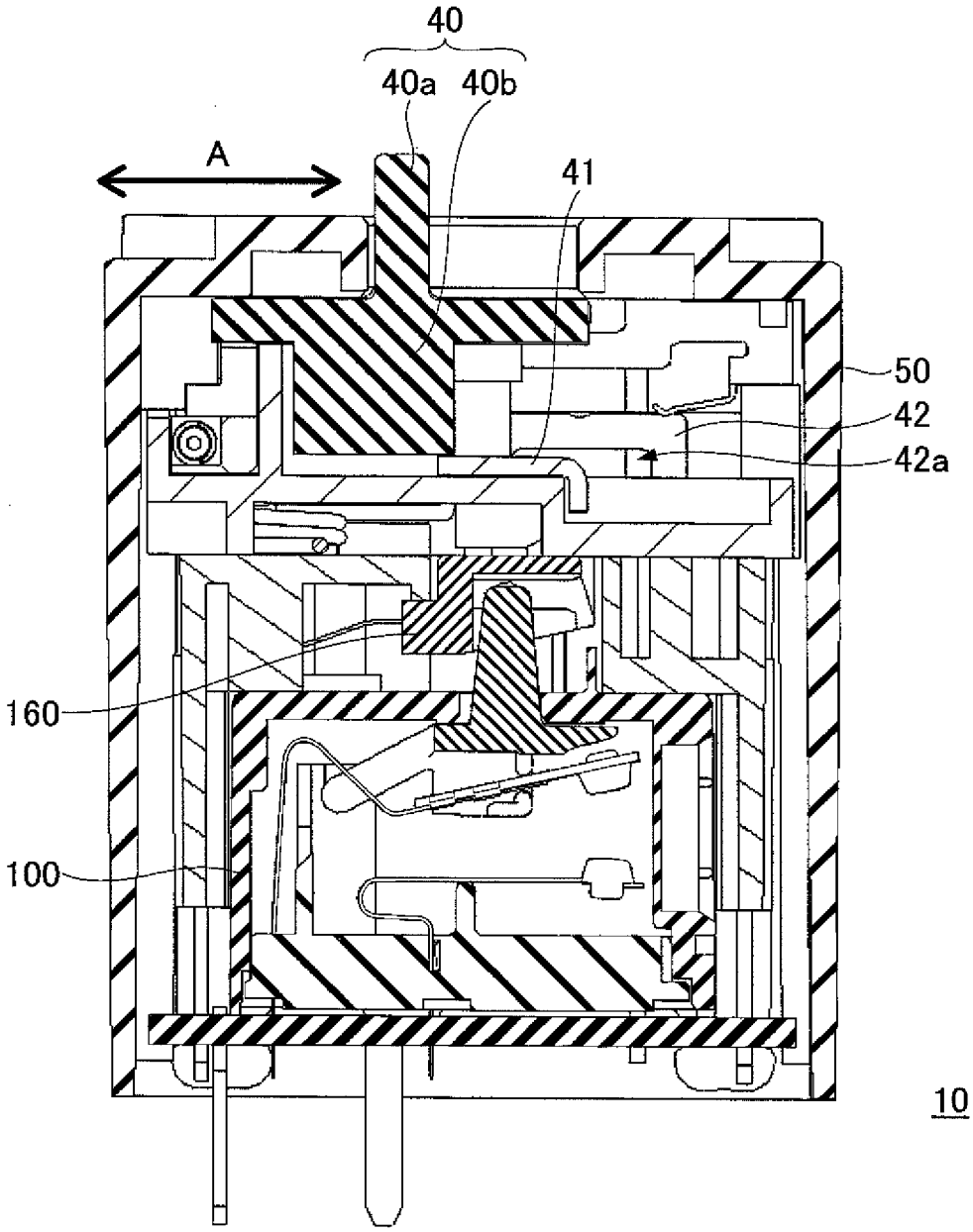
FIG. 9 is a cross-sectional view showing an example of the internal structure of the jack connector of the first embodiment.

The internal structure of the jack connector 10 of the embodiment is explained in detail with reference to FIG. 9. FIG. 9 is a cross-sectional view showing an example of the internal structure of the jack connector 10.

The jack connector 10 further includes a link portion 41, a contact slide portion 42, and a switch device 100.

The switch device 100 includes a button 160 that functions to switch on and off the electrical connection between the jack connector 10 and the plug connector 300, as will be explained later.

The operation unit 40 includes a sliding body portion **40*b* and an operational protruding portion 40*a* which is provided at an upper portion of the sliding body portion 40*b*. The operational protruding portion 40*a* protrudes outside the housing 50 from an opening provided at a top of the housing 50**.

The jack connector 10 is configured such that when the operational protruding portion **40*a* of the operation unit 40 is moved in a direction shown by an arrow "A" (which will be referred to as a sliding direction), the switch device 100 is also operated to switch on and off the electrical connection between the jack connector 10 and the plug connector 300** (in other words, the electrical connection between the electric device and the power source).

The sliding body portion 40*b* is housed in the housing 50 and is connected to the link portion 41.

The contact slide portion 42 is provided with a slide opening 42*a* and a protruding contacting portion (not shown in the drawings). The protruding contacting portion is formed to extend in a direction (downward direction in FIG. 9) substantially perpendicular to the sliding direction. The protruding contacting portion of the contact slide portion 42 is provided to contact a top of the button 160 of the switch device 100 when the contact slide portion 42 is moved by the link portion 41.

The slide opening 42*a* is formed to extend in a direction substantially parallel to the sliding direction.

The link portion 41 is configured to be moved in a direction substantially parallel to the sliding direction. The link portion 41 is formed to have an "L" shape where one end of the "L" shape structure is inserted in the slide opening 42*a* of the contact slide portion 42 to be slidable within the slide opening 42*a* in the direction substantially perpendicular to the sliding direction.

The plug connector 300 and the jack connector 10 may be configured such that a hook (not shown in the drawings) of the jack connector 10 is fitted to the opening 312 of the plug connector 300 (see FIG. 4) when the operation unit 40 is operated to be positioned at the "ON" position and the electric power is supplied to the plug connector 300. Further, the plug connector 300 and the jack connector 10 may be configured such that the hook of the jack connector 10 is released from the opening 312 of the plug connector 300 when the operation unit 40 is operated to be positioned at the "OFF" position so that the plug connector 300 can be released from the jack connector 10. Further, the jack connector 10 may be configured such that the operation unit 40 cannot be moved to the "ON" position when the plug connector 300 is not physically connected to the jack connector 10, in other words, when the hook (not shown in the drawings) of the jack connector 10 is not fitted to the opening 312 of the plug connector 300.

(Switch Device)

The structure of the switch device 100 is now explained. The switch device 100 of the jack connector 10 functions to control supplying of the electric power from the power source. The switch device 100 may be referred to as a "power switch" as well.

Figure 10:
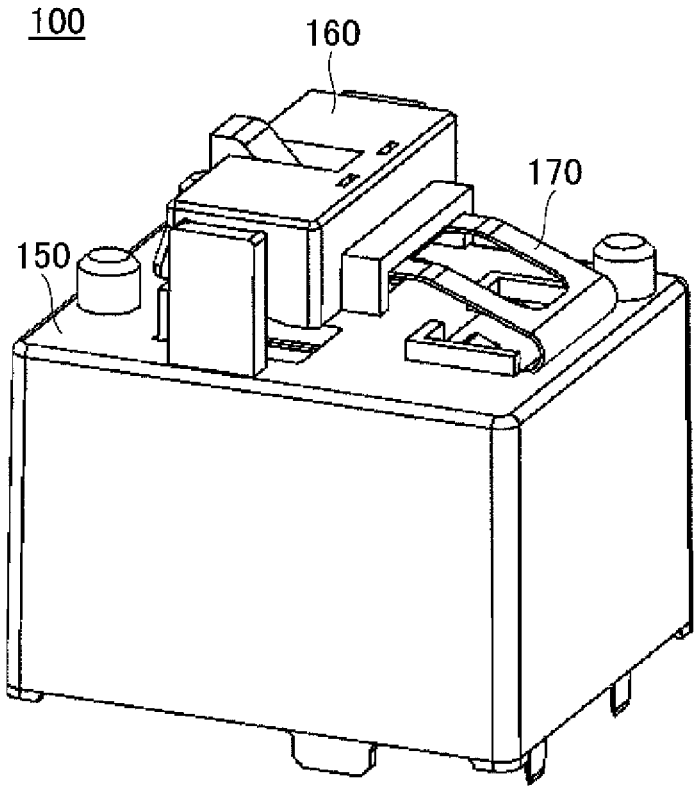
FIG. 10 is a perspective view of an example of a switch device of the first embodiment.
Figure 11:
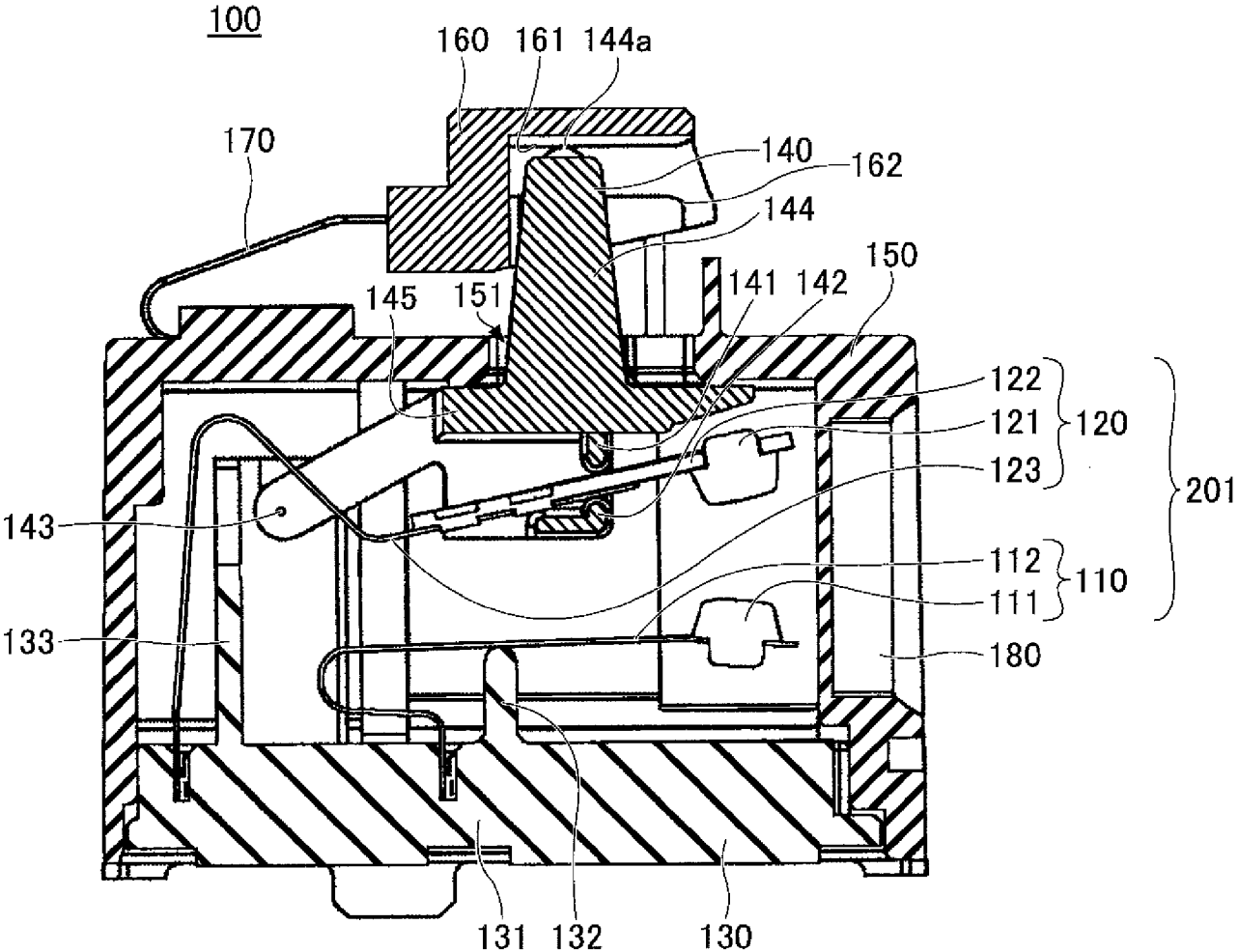
FIG. 11 is a cross-sectional view of an example of the switch device of the first embodiment.

FIG. 10 is a perspective view of an example of the switch device 100. FIG. 11 is a cross-sectional view of the switch device 100 showing an example of the internal structure of the switch device 100.

Referring to FIG. 11, the switch device 100 includes contacting portions 201 including fixed portions 110 and movable portions 120, a base block 130, a card member 140, a switch device housing 150, the button 160, a spring 170 and a magnet unit including permanent magnets 180.

Figure 13:
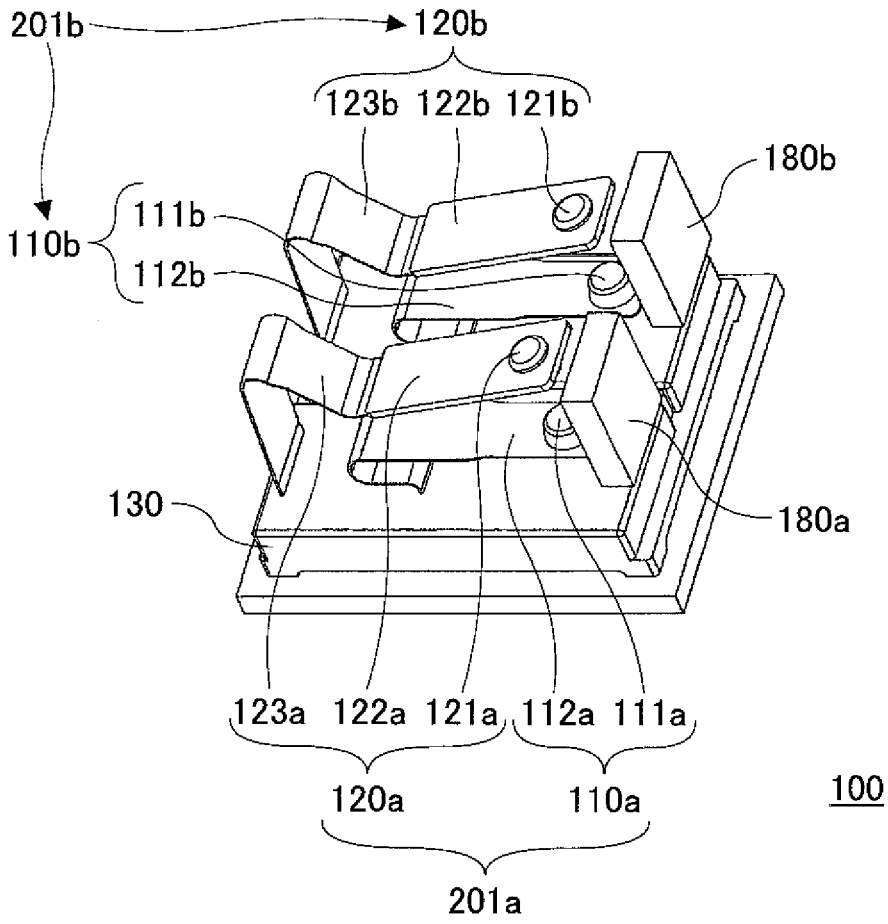
FIG. 13 is a perspective view of an example of the switch device of the first embodiment.
Figure 14:
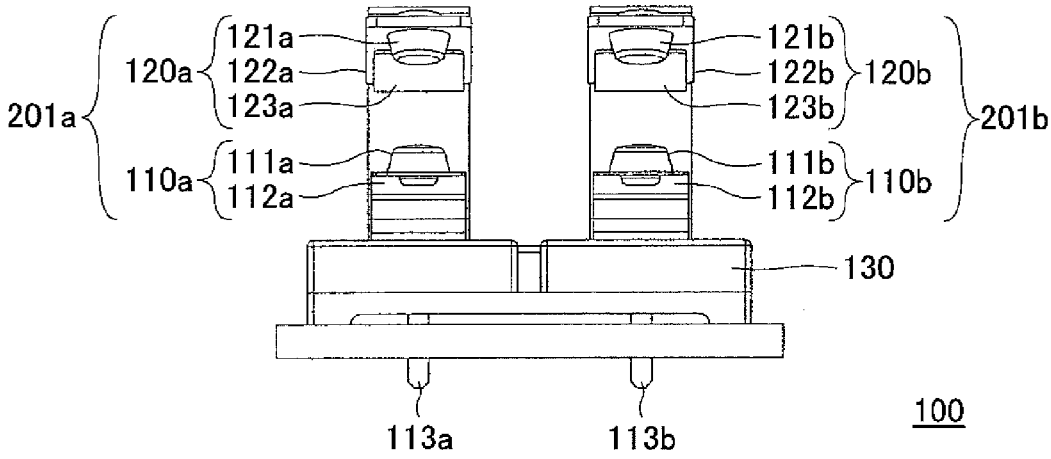
FIG. 14 is an elevation view of an example of the switch device of the first embodiment.

As will be explained later, the switch device 100 of the embodiment includes two of the contacting portions 201 each including the fixed portion 110 (a first fixed portion 110*a* or a second fixed portion 110*b*) and the movable portion 120 (a first movable portion 120*a* or a second movable portion 120*b*), and the permanent magnets 180 (a first permanent magnet 180*a* and a second permanent magnet 180*b*), although only one of each of them is shown in FIG. 10 and FIG. 11 (see also FIG. 13, FIG. 14 and the like).

The base block 130 includes a base block body portion 131, a fixed portion support portion 132 and an insulating wall 133. The insulating wall 133 may be made of fire-retardant resin or the like, for example.

The fixed portions 110 are made entirely of an electrical conductive material such as a metal or the like. Each of the fixed portions 110 includes a fixed spring 112 and a fixed contacting portion 111 provided at one end of the fixed spring 112. The fixed spring 112 may be formed by bending a metal plate or the like made of copper, an alloy including copper or the like, for example. The fixed contacting portion 111 may be made of an alloy including silver and copper, for example. Another end of the fixed spring 112 is fixed at the base block body portion 131 of the base block 130 and the middle part of the fixed spring 112 is supported by the fixed portion support portion 132 of the base block 130.

Similar to the fixed portions 110, the movable portions 120 are made entirely of an electrical conductive material such as a metal or the like. Each of the fixed portions 110 includes a movable plate portion 122, a movable spring 123 and a movable contacting portion 121. The movable contacting portion 121 is provided at one end of the movable plate portion 122 to correspond to the fixed contacting portion 111 of the fixed portions 110 to be contacted. One end of the movable spring 123 is connected to another end of the movable plate portion 122. The movable plate portion 122 and the movable spring 123 may be formed by bending a metal plate or the like made of copper, an alloy including copper or the like, for example. The movable contacting portion 121 may be made of an alloy including silver and copper, for example. Another end of the movable spring 123 is fixed in the base block body portion 131 of the base block 130. As the movable spring 123 is formed by bending the metal plate or the like, for example, the movable spring 123 has flexibility. Thus, the movable contacting portion 121 provided at the one end of the movable plate portion 122 is capable of being moved in an upward and downward direction.

The insulating wall 133 of the base block 130 is provided between a portion where the other end of the fixed spring 112 is fixed and a portion where the other end of the movable spring 123 is fixed. Thus, the movable spring 123 is bent to pass over the insulating wall 133 of the base block 130.

The switch device housing 150 is provided with a switch device opening 151 formed at its upper surface.

The card member 140 includes an upper contacting portion 141, a lower contacting portion 142, a rotating shaft 143, a protruding portion 144, a body portion 145, and a contacting portion 144*a* provided at upper portion of the protruding portion 144.

The card member 140, the base block 130 and the switch device housing 150 may be made of an insulating material such as resin or the like, respectively.

The upper contacting portion 141 of the card member 140 is provided to contact one surface (upper surface in FIG. 11) of the movable plate portion 122 of the movable portion 120, and the lower contacting portion 142 of the card member 140 is provided to contact the other surface (lower surface in FIG. 11) of the movable plate portion 122 of the movable portion 120. In other words, the movable plate portion 122 of the movable portion 120 is sandwiched by the upper contacting portion 141 and the lower contacting portion 142 of the card member 140. Further, the upper contacting portion 141 and the lower contacting portion 142 of the card member 140 are provided to slide on the one surface and the other surface of the movable plate portion 122, respectively. Thus, in order to reduce frictional resistance, the upper contacting portion 141 and the lower contacting portion 142 may be provided with surface layers made of fluorocarbon resin or the like at the surfaces, respectively.

Under this state, when the card member 140 is rotated around the rotating shaft 143, the force is applied to the movable plate portion 122 via the upper contacting portion 141 or the lower contacting portion 142 of the card member 140 so that the movable contacting portion 121 is moved downward or upward, respectively.

The fixed portions 110 and the movable portions 120 are provided within an area surrounded by the base block 130 and the switch device housing 150. The protruding portion 144 of the card member 140 is provided to protrude outside of the switch device housing 150 from the switch device opening 151 of the switch device housing 150. The body portion 145, the upper contacting portion 141 and the lower contacting portion 142 of the card member 140 are provided within an area surrounded by the base block 130 and the switch device housing 150.

The button 160 is provided outside the switch device housing 150 to push the protruding portion 144 of the card member 140 for rotating the card member 140 around the rotating shaft 143. The contacting portion 144*a* of the card member 140 contacts an inner wall portion 161 of the button 160. The contacting portion 144*a* of the card member 140 is provided to slide on a surface of the inner wall portion 161. Thus, in order to reduce frictional resistance, the inner wall portion 161 may be provided with a surface layer made of fluorocarbon resin or the like at the surface.

The spring 170 is provided outside the switch device housing 150. One end of the spring 170 is connected to the switch device housing 150 and the other end of the spring 170 is connected to the button 160.

The switch device 100 is configured to supply the electric power to the plug connector 300 when the fixed contacting portions 111 of the fixed portions 110 and the movable contacting portions 121 of the movable portions 120 are in contact, respectively, and terminate supplying of the electric power to the plug connector 300 when the fixed contacting portions 111 of the fixed portions 110 and the movable contacting portions 121 of the movable portions 120 are not in contact, respectively.

(ON and OFF Operation of Switch Device)

It is assumed that the plug connector 300 and the jack connector 10 are physically connected at this time. Then, when the operation unit 40 is operated to be positioned at the "ON" position, the sliding body portion 40*b* is moved in the sliding direction shown by the arrow "A" (see FIG. 9). With the movement of the body portion 40*b* of the operation unit 40, the link portion 41 is also moved in the sliding direction to move the contact slide portion 42 in the sliding direction as well. Thus, the protruding contacting portion (not shown in the drawings) of the contact slide portion 42 is positioned to push the button 160 of the switching portion downward.

With this operation, the contacting portion 141 of the card member 140 is pushed by the inner wall portion 161 of the button 160 so that the card member 140 is rotated around the rotating shaft 143.

Then, the force is applied to the movable plate portions 122 of the movable portions 120 through the upper contacting portion 141 of the card member 140 in a downward direction so that the movable contacting portions 121 and the fixed contacting portions 111 of the fixed portions 110 make contact, respectively.

Figure 12:
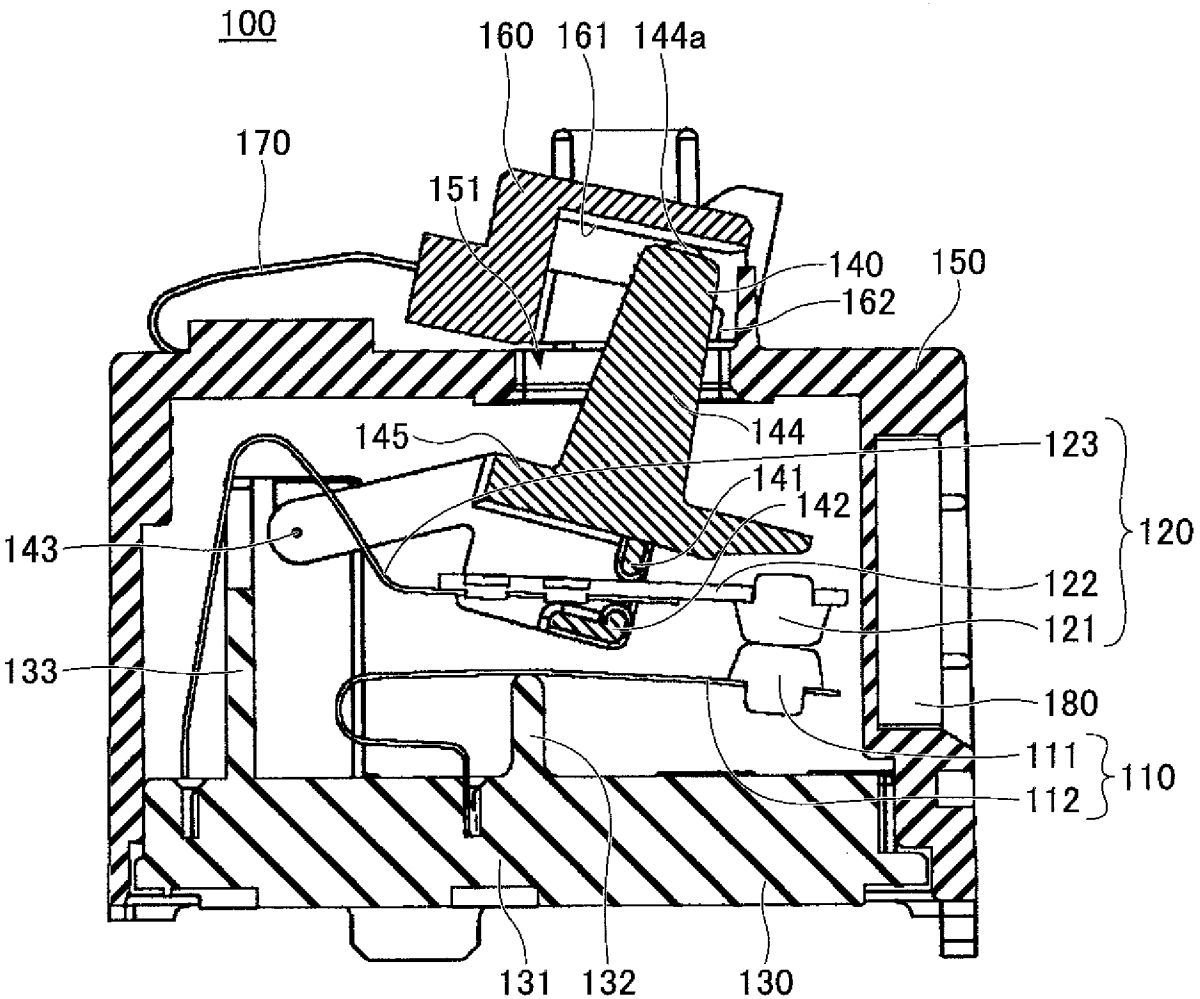
FIG. 12 is a cross-sectional view of an example of the switch device of the first embodiment.

FIG. 12 is a cross-sectional view of the switch device 100 when the fixed contacting portions 111 and the movable contacting portions 121 make contact, respectively.

Although not shown in the drawings, the contact slide portion 42 is configured to maintain this status while the operation unit 40 is positioned at the "ON" position. Thus, the movable contacting portions 121 and the fixed contacting portions 111 are in contact while the operation unit 40 is positioned at the "ON" position so that the electric power is supplied from the power source to the electric device.

Further, when the operation unit 40 is operated to be positioned at the "OFF" position, the contact slide portion 42 is released from pushing the button 160 so that the force applied to the button 160 is released. At this time, the button 160 is moved back in an upper direction by the spring force of the spring 170. With this operation, the card member 140 is rotated around the rotating shaft 143 in the upper direction so that the force in the upward direction is applied to the movable plate portions 122 of the movable portions 120 through the lower contacting portion 142 of the card member 140. Specifically, when the button 160 is moved back in the upper direction, a step portion 162 provided at an inside wall of the button 160 engages with a protruding portion (not shown in the drawings) provided at the card member 140 so that the card member 140 is moved with the button 160 to be rotated around the rotating shaft 143.

Then, the movable contacting portions 121 are moved upward to be apart from the corresponding fixed contacting portions 111 to terminate the supply of the electric power from the power source.

At this time, a case may occur where electric arcs are generated between the movable contacting portions 121 and the corresponding fixed contacting portions 111. Thus, according to the switch device 100 of the embodiment, the permanent magnets 180 are provided near contacting areas of the movable contacting portions 121 and the corresponding fixed contacting portions 111 to blow off the electric arcs by magnetic fields. The permanent magnets 180 are provided to generate the magnetic fields in a direction substantially perpendicular to a direction in which the electric arcs are generated.

Alternatively, electro-magnets may be used instead of the permanent magnets 180.

Further, in the switch device 100, the spring force of the spring 170, which is provided outside the switch device housing 150, is used to terminate supplying of the electric power from the power source, instead of using the resilience of the springs of the movable portions 120 such as the movable springs 123 or the like. Thus, even when the movable springs 123 of the movable portions 120 do not have the resilience, supplying of the power source can be terminated.

Here, there is a possibility that heat is generated inside the switch device housing 150 so that the fixed portions 110 and the movable portions 120 may be affected by the heat. However, as the spring 170 is provided outside the switch device housing 150, the spring 170 is not affected by the heat generated inside the switch device housing 150.

Therefore, even in a case when a part of the movable springs 123 or the like is melted by the heat generated inside the switch device housing 150, and the movable springs 123 or the like begin to not function as springs, supplying of the power source can be terminated by the spring force of the spring 170 without using the resilience of the movable springs 123 or the like.

It means that supplying of the electric power from the power source can be surely terminated.

Further, in the switch device 100, the insulating wall 133 is provided at the base block 130 between the portion where the other end of the fixed spring 112 is fixed and the portion where the other end of the movable spring 123 is fixed. With this structure, even when a part of the fixed portions 110 and the movable portions 120 is melted by the heat, the melted portion of the fixed portions 110 and melted portion of the movable portions 120 are separated by the insulating wall 133. Thus, a condition in which the melted portion of the fixed portions 110 and the melted portion of the movable portions 120 make contact so that the current of the power source continues to flow (short of the fixed portion 110 and the corresponding movable portion 120), can be prevented from occurring.

(Structure of Switch Device)

Figure 15:
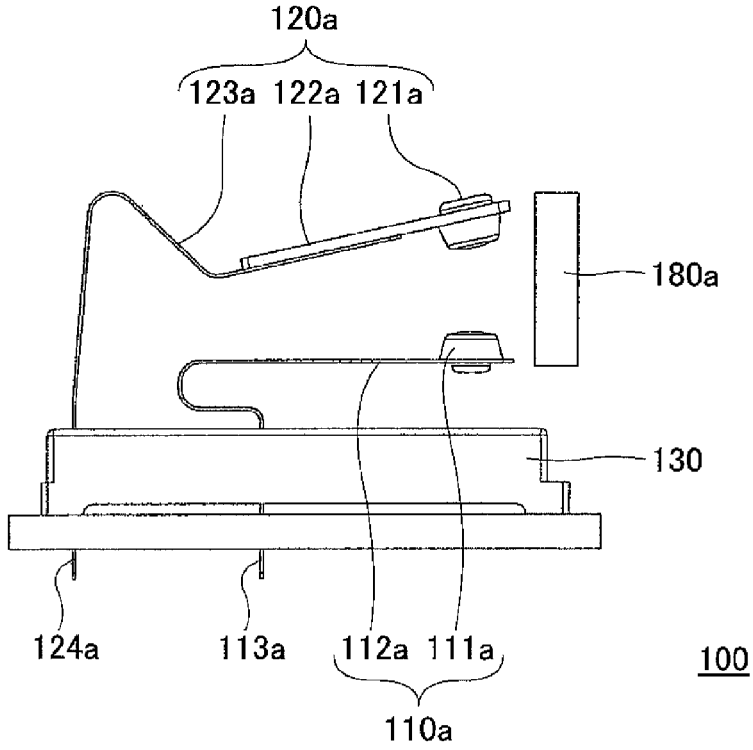
FIG. 15 is a side view of an example of the switch device of the first embodiment.
Figure 16:
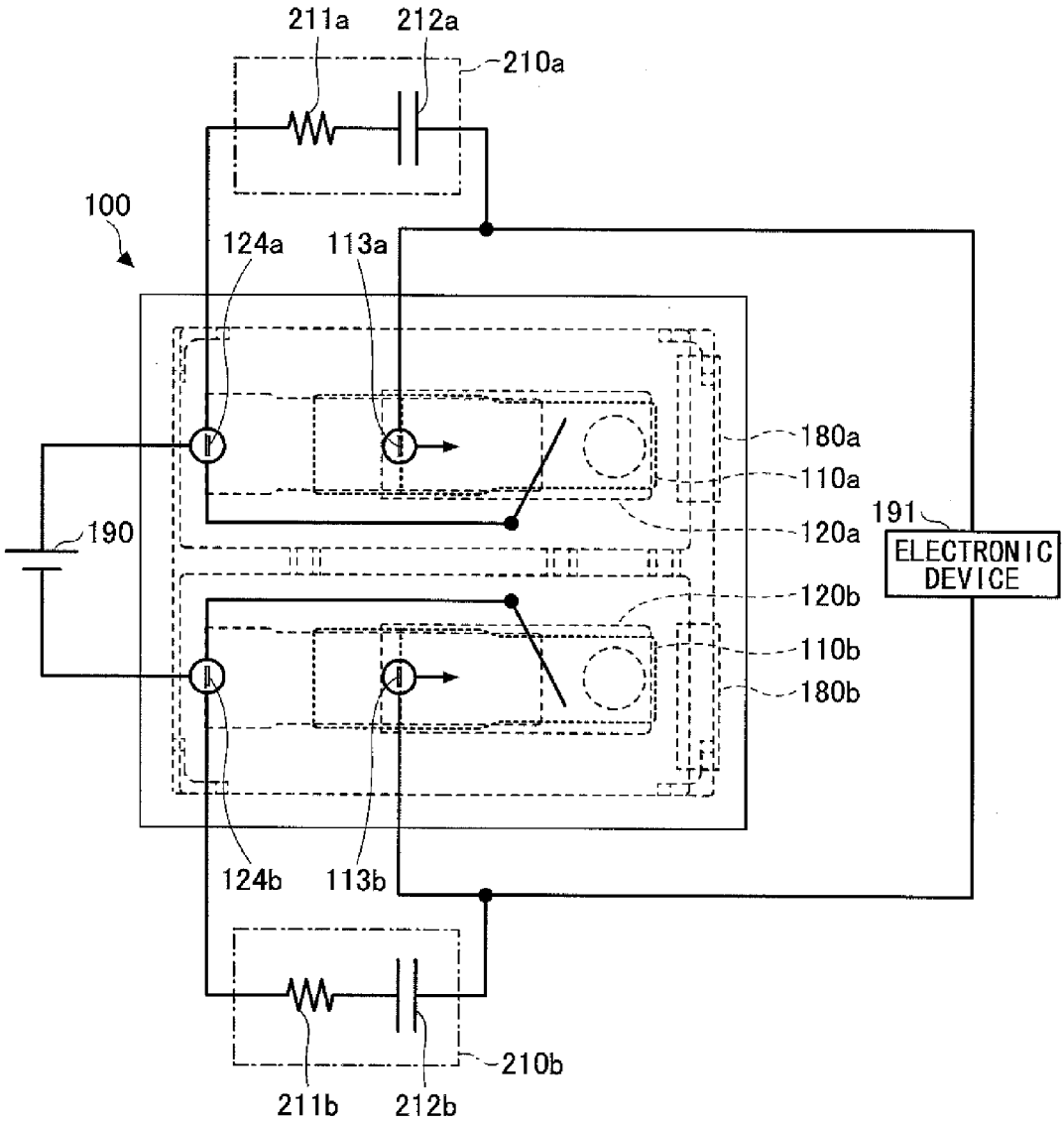
FIG. 16 is a bottom schematic view for explaining an example of the switch device of the first embodiment.

The switch device 100 of the embodiment is explained in detail. FIG. 13 is a perspective view of an example of the switch device 100, FIG. 14 is an elevation view of an example of the switch device 100, FIG. 15 is a side view of an example of the switch device 100 and FIG. 16 is a bottom schematic view of an example of the switch device 100.

As shown in FIG. 13 to FIG. 16, the switch device 100 of the embodiment includes a first contacting portion 201*a* and a second contacting portion 201*b* corresponding to the switching portions 201, and a first permanent magnet 180*a* and a second permanent magnet 180*b* corresponding to the permanent magnets 180. The switch device 100 further includes a fixed portion external terminal 113*a*, a fixed portion external terminal 113*b*, a movable portion external terminal 124*a* and a movable portion external terminal 124*b*.

The first contacting portion 201*a* includes a first fixed portion 110*a* and a first movable portion 120*a*. The second contacting portion 201*b* includes a second fixed portion 110*b* and a second movable portion 120*b*. Here, the first fixed portion 110*a* and the second fixed portion 110*b* correspond to the fixed portions 110. The first movable portion 120*a* and the second movable portion 120*b* correspond to the movable portions 120.

In the switch device 100 of the embodiment, the electric power from a power source 190 can be supplied to an electronic device 191 when both the first fixed portion 110*a* and the first movable portion 120*a* are in contact, and the second fixed portion 110*b* and the second movable portion 120*b* are in contact.

The first fixed portion 110*a* includes a first fixed contacting portion 111*a* and a fixed spring 112*a* which is electrically connected to the fixed portion external terminal 113*a*. Similarly, the second fixed portion 110*h* includes a second fixed contacting portion 111*b* and a fixed spring 112*b* which is electrically connected to the fixed portion external terminal 113*b*. The first fixed contacting portion 111*a* and the second fixed contacting portion 111*b* correspond to the fixed contacting portions 111, and the fixed spring 112*a* and the fixed spring 112*b* correspond to the fixed springs 112.

The first movable portion 120*a* includes a first movable contacting portion 121*a*, a movable plate portion 122*a* and a movable spring 123*a* which is electrically connected to the movable portion external terminal 124*a*. Similarly, the second movable portion 120*b* includes a second movable contacting portion 121*b*, a movable plate portion 122*b* and a movable spring 123*b* which is electrically connected to the movable portion external terminal 124*b*. The first movable contacting portion 121*a* and the second movable contacting portion 121*b* correspond to the movable contacting portions 121, the movable plate portion 122*a* and the movable plate portion 122*b* correspond to the movable plate portions 122, and the movable spring 123*a* and the movable spring 123*b* correspond to the movable springs 123.

Further, as shown in FIG. 16, the switch device 100 of the embodiment further includes a first electric arc voltage suppression unit 210*a* and a second electric arc voltage suppression unit 210*b*. The first electric arc voltage suppression unit 210*a* includes a first resistor 211*a* and a first capacitor 212*a* connected in series and is provided between the fixed portion external terminal 113*a* and the movable portion external terminal 124*a*. Similarly, the second electric arc voltage suppression unit 210*b* includes a second resistor 211*b* and a second capacitor 212*b* connected in series and is provided between the fixed portion external terminal 113*b* and the movable portion external terminal 124*b*.

Specifically, the first electric arc voltage suppression unit 210*a* is provided between the first fixed contacting portion 111*a* and the first movable contacting portion 121*a*. In other words, one end of the first resistor 211*a* is connected to the movable portion external terminal 124*a*, which is electrically connected to the first movable contacting portion 121*a*, another end of the first resistor 211*a* is connected to one end of the first capacitor 212*a* and another end of the first capacitor 212*a* is connected to the fixed portion external terminal 113*a*, which is electrically connected to the first fixed contacting portion 111*a*.

Similarly, the second electric arc voltage suppression unit 210*b* is provided between the second fixed contacting portion 111*b* and the second movable contacting portion 121*b*. In other words, one end of the second resistor 211*b* is connected to the movable portion external terminal 124*b*, which is electrically connected to the second movable contacting portion 121*b*, another end of the second resistor 211*b* is connected to one end of the second capacitor 212*b*, and another end of the second capacitor 212*b* is connected to the fixed portion external terminal 113*b*, which is electrically connected to the second fixed contacting portion 111*b*.

In this embodiment, the cathode of the power source 190 is electrically connected to the movable portion external terminal 124*a* of the first movable portion 120*a*, and the anode of the power source 190 is electrically connected to the movable portion external terminal 124*b* of the second movable portion 120*b*, in this embodiment.

Further, the fixed portion external terminal 113*a* of the first fixed portion 110*a* is electrically connected to one of the terminals of the electronic device 191 to which the electric power is to be supplied, and the fixed portion external terminal 113*b* of the second fixed portion 110*b* is electrically connected to the other of the terminals of the electronic device 191. As described above, in this embodiment, the switch device 100 of the jack connector 10 is electrically connected to the electric device 191 via the plug connector 300, although the plug connector 300 is not shown in FIG. 16.

The first permanent magnet 180*a* is provided to correspond to the first fixed portion 110*a* and the first movable portion 120*a*. The first permanent magnet 180*a* has a function to blow off an electric arc generated between the first fixed contacting portion 111*a* and the first movable contacting portion 121*a* by a magnetic field.

Similarly, the second permanent magnet 180*b* is provided to correspond to the second fixed portion 110*b* and the second movable portion 120*b*. The second permanent magnet 180*b* has a function to blow off an electric arc generated between the second fixed contacting portion 111*b* and the second movable contacting portion 121*b* by a magnetic field.

In this embodiment, the first permanent magnet 180*a* and the second permanent magnet 180*b* are provided such that the directions to blow off the electric arcs generated between the first fixed contacting portion 111*a* and the first movable contacting portion 121*a*, and between the second fixed contacting portion 111*b* and the second movable contacting portion 121*b* become opposite from each other. Specifically, the first permanent magnet 180*a* may be provided such that the electric arc generated between the first fixed contacting portion 111*a* and the first movable contacting portion 121*a* is blown off in an outward direction (a direction opposite to the second contacting portion 201*b*). Similarly, the second permanent magnet 181*b* may be provided such that the electric arc generated between the second fixed contacting portion 111*b* and the second movable contacting portion 121*b* is blown off in an outward direction (a direction opposite to the first contacting portion 201*a*).

Thus, in this embodiment, the first permanent magnet 180*a* and the second permanent magnet 180*b* are provided to generate magnetic fields in the same directions as the current flow between the first fixed contacting portion 111*a* and the first movable contacting portion 121*a*, and between the second fixed contacting portion 111*b* and the second movable contacting portion 121*b*, respectively, which are in different directions. Specifically, the first permanent magnet 180*a* is placed such that the South Pole faces the side where the first fixed contacting portion 111*a* and the first movable contacting portion 121*a* are provided. Similarly, the second permanent magnet 180*b* is placed such that the South Pole faces the side where the second fixed contacting portion 111*b* and the second movable contacting portion 121*b* are provided.

With this structure, the magnetic field by the first permanent magnet 180*a* is generated between the first fixed contacting portion 111*a* and the first movable contacting portion 121*a*, and the magnetic field by the second permanent magnet 180*b* is generated between the second fixed contacting portion 111*b* and the second movable contacting portion 121*b*. Alternatively, instead of the first permanent magnet 180*a* and the second permanent magnet 180*b*, electro-magnets may be used.

Under a state where the power source 190 and the electronic device 191 are electrically connected, in other words, both the first fixed contacting portion 111*a* and the first movable contacting portion 121*a* are electrically connected, and the second fixed contacting portion 111*b* and the second movable contacting portion 121*b* are electrically connected, a current is supplied from the cathode of the power source 190 to the movable portion external terminal 124*a*. Then, the current flows through the first movable portion 120*a*, the first fixed portion 110*a* via the first movable contacting portion 121*a* and the first fixed contacting portion 111*a* and the fixed portion external terminal 113*a* in this order to be supplied to the electronic device 191. Then, the current further flows from the electronic device 191 through the fixed portion external terminal 113*b*, the second fixed portion 110*b*, the second movable portion 120*b* via the second fixed contacting portion 111*b* and the second movable contacting portion 121*h*, and the movable portion external terminal 124*b* in this order to reach the anode of the power source 190.

Thereafter, when the first fixed contacting portion 111*a* and the first movable contacting portion 121*a* are not in contact with each other, as well as when the second fixed contacting portion 111*b* and the second movable contacting portion 121*b* are not in contact with each other, the electrical connection between the power source 190 and the electronic device 191 is broken or stopped.

Under this state, a case may occur where electric arcs are generated between the first fixed contacting portion 111*a* and the first movable contacting portion 121*a*, and between the second fixed contacting portion 111*b* and the second movable contacting portion 121*b*.

However, according to the switch device 100 of the embodiment, the first electric arc voltage suppression unit 210*a* including the first resistor 211*a* and the first capacitor 212*a* is electrically connected between the first fixed contacting portion 111*a* and the first movable contacting portion 121*a*. Further, the second electric arc voltage suppression unit 210*b* including the second resistor 211*b* and the second capacitor 212*b* is electrically connected between the second fixed contacting portion 111*b* and the second movable contacting portion 121*b*. Thus, electric charges, which may cause generation of arc discharge, flow into the first capacitor 212*a* and the second capacitor 212*b* through the first resistor 211*a* and the second resistor 211*b*, respectively, to suppress the arc discharge.

As described above, by providing the first electric arc voltage suppression unit 210*a* and the second electric arc voltage suppression unit 210*b*, the arc discharge can be suppressed so that durability and reliability of the first fixed contacting portion 111*a*, the first movable contacting portion 121*a*, the second fixed contacting portion 111*b* and the second movable contacting portion 121*b* can be improved. With this, durability and reliability of the switch device 10 and the jack connector 100 can also be improved.

Second Embodiment

In this embodiment, a counter-electromotive force suppression unit is provided instead of the first electric arc voltage suppression unit 210*a* and the second electric arc voltage suppression unit 210*b* as explained in the first embodiment.

Figure 17:
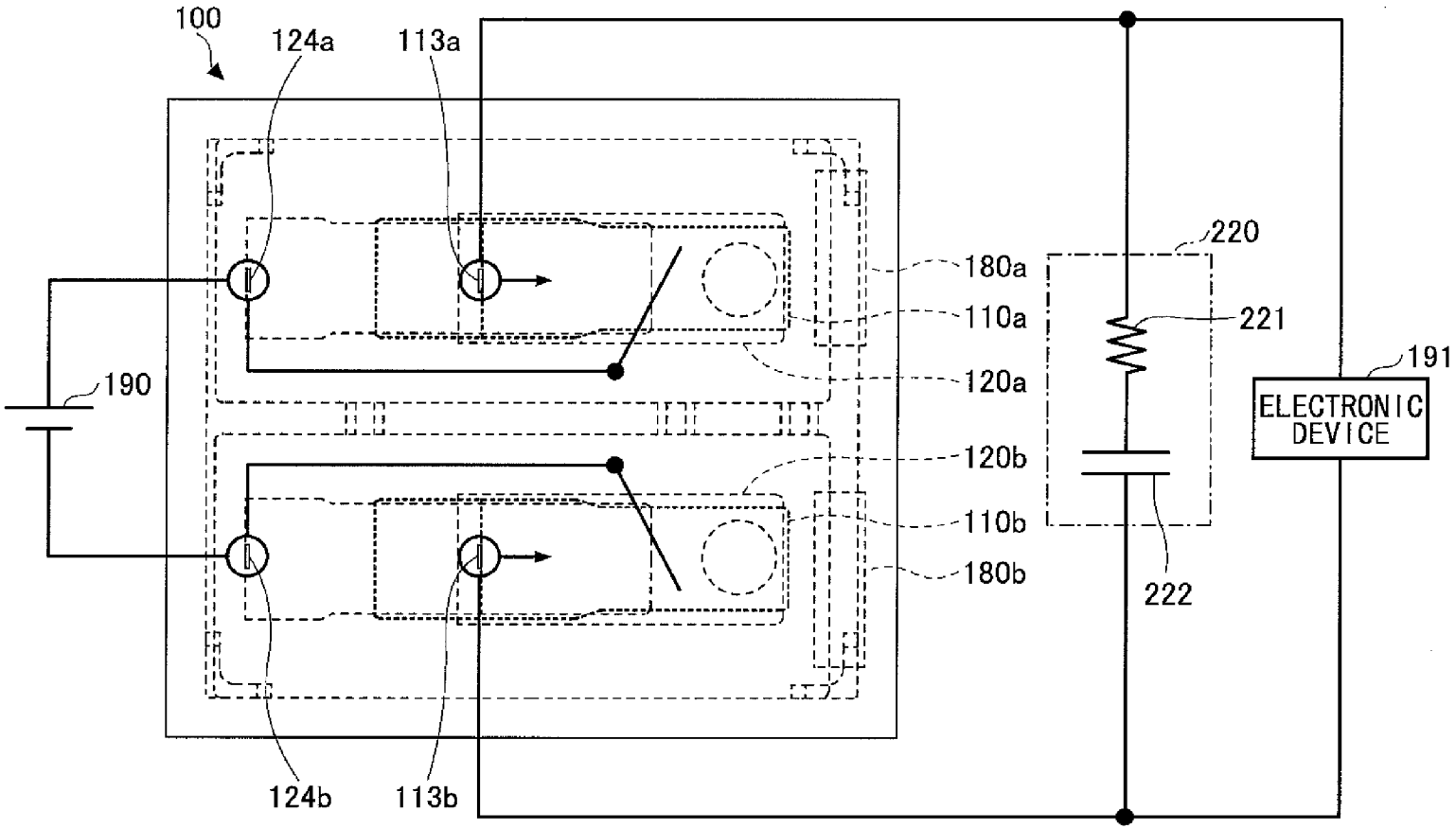
FIG. 17 is a schematic view for explaining an example of a switch device of a second embodiment.

FIG. 17 is a schematic view of an example of the switch device 100 of the second embodiment. FIG. 17 shows a bottom side of the switch device 100.

The switch device 100 of the second embodiment includes a counter-electromotive force suppression unit 220 for suppressing generation of counter-electromotive force by the electronic device 191 which may occur when the electrical connections between the first fixed contacting portion 111*a* and the first movable contacting portion 121*a*, and between the second fixed contacting portion 111*b* and the second movable contacting portion 121*b* are broken. The counter-electromotive force suppression unit 220 is electrically connected to the fixed portion external terminal 113*a* and the fixed portion external terminal 113*b* to be electrically connected to the electronic device 191 in parallel.

In this embodiment, the counter-electromotive force suppression unit 220 includes a resistor 221 and a capacitor 222 which are connected in series between the fixed portion external terminal 113*a* and the fixed portion external terminal 113*b*. In other words, the counter-electromotive force suppression unit 220 is connected to the electronic device 191 in parallel.

By providing the counter-electromotive force suppression unit 220 including the resistor 221 and the capacitor 222 connected in series between the fixed portion external terminal 113*a* and the fixed portion external terminal 113*b*, generation of counter-electromotive force by the electronic device 191 can be suppressed when the electrical connections between the first fixed contacting portion 111*a* and the first movable contacting portion 121*a*, and between the second fixed contacting portion 111*b* and the second movable contacting portion 121*b* are broken.

With this structure, durability and reliability of the first fixed contacting portion 111*a*, the first movable contacting portion 121*a*, the second fixed contacting portion 111*b* and the second movable contacting portion 121*b* can be improved. With this, durability and reliability of the switch device 10 and the jack connector 100 can also be improved.

(Another Structure of Switch Device)

Figure 18:
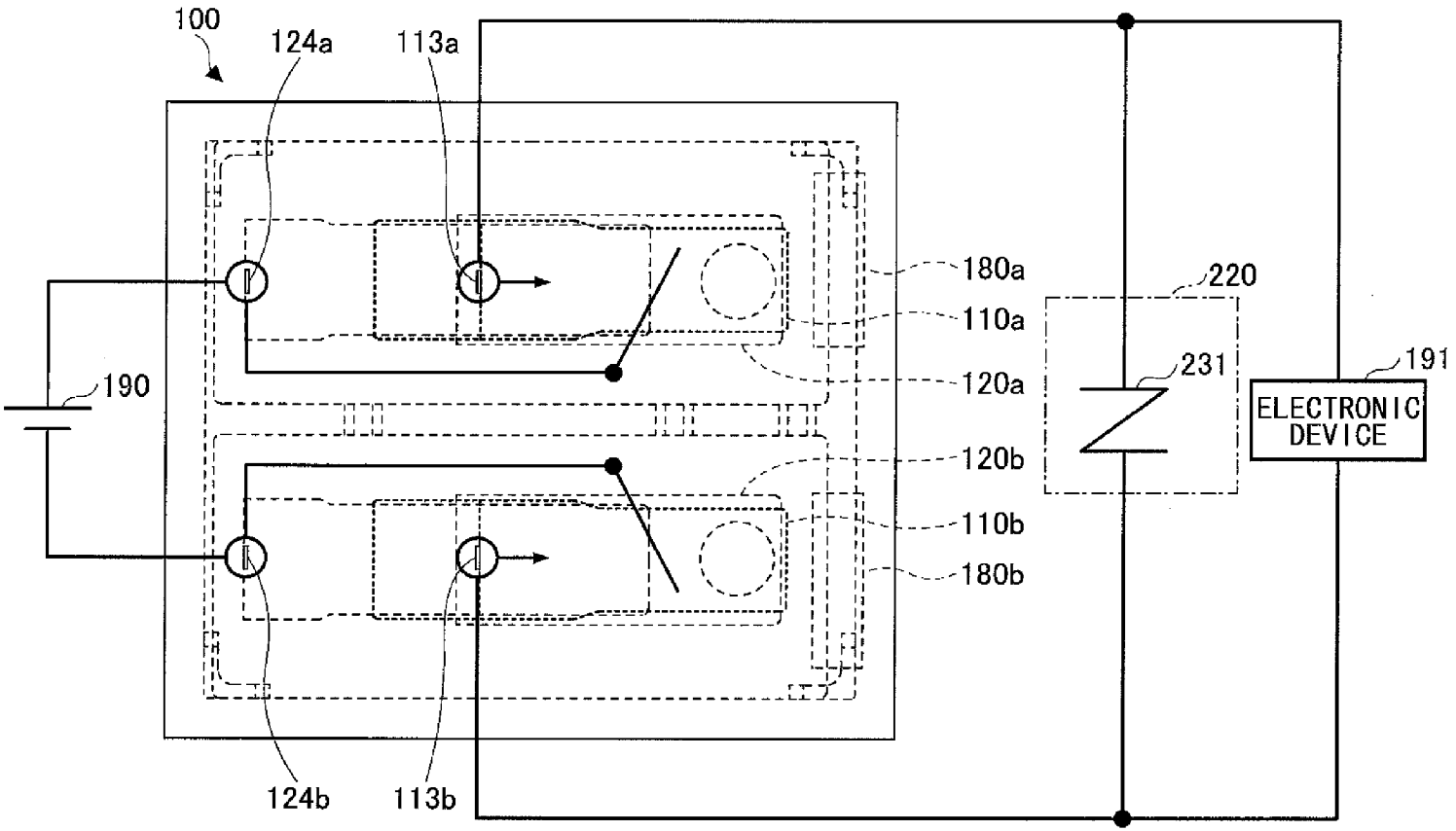
FIG. 18 is a schematic view for explaining another example of a switch device of the second embodiment.

FIG. 18 is a schematic view of another example of the switch device 100 of the second embodiment. FIG. 18 shows a bottom side of the switch device 100.

The counter-electromotive force suppression unit 220 of this example includes a varistor 231 instead of the resistor 221 and the capacitor 222 shown in FIG. 17.

In this example, specifically, one of the terminals of the varistor 231 is electrically connected to the fixed portion external terminal 113*a* and the other of the terminals of the varistor 231 is electrically connected to the fixed portion external terminal 113*b*.

(Another Structure of Switch Device)

Figure 19:
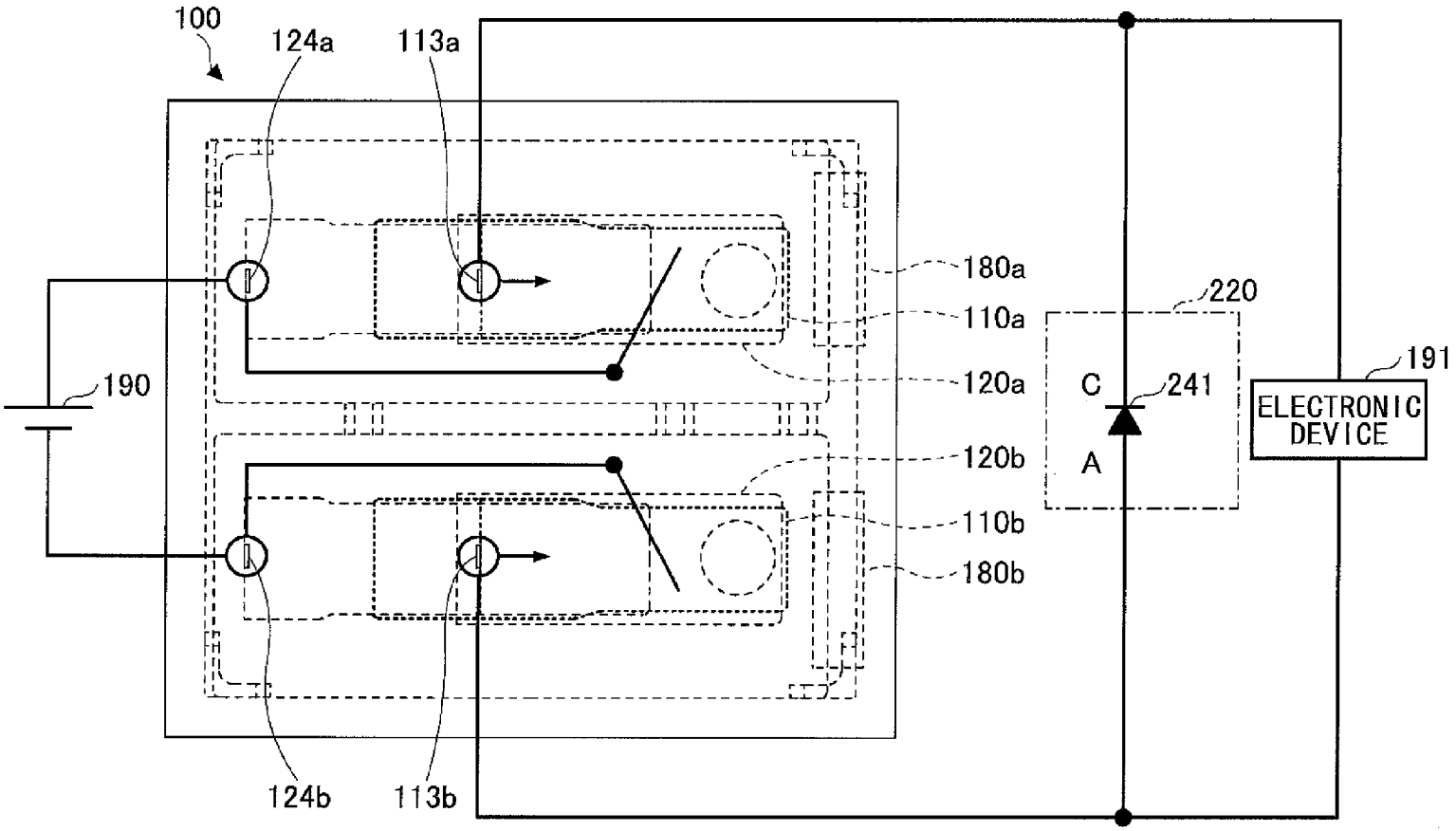
FIG. 19 is a schematic view for explaining another example of a switch device of the second embodiment.

FIG. 19 is a schematic view of another example of the switch device 100 of the second embodiment. FIG. 19 shows a bottom side of the switch device 100.

The counter-electromotive force suppression unit 220 of this example includes a diode 241 instead of the resistor 221 and the capacitor 222 shown in FIG. 17.

In this example, specifically, the cathode of the diode 241 is electrically connected to the fixed portion external terminal 113*a* and the anode of the diode 241 is electrically connected to the fixed portion external terminal 113*h*.

(Another Structure of Switch Device)

Figure 20:
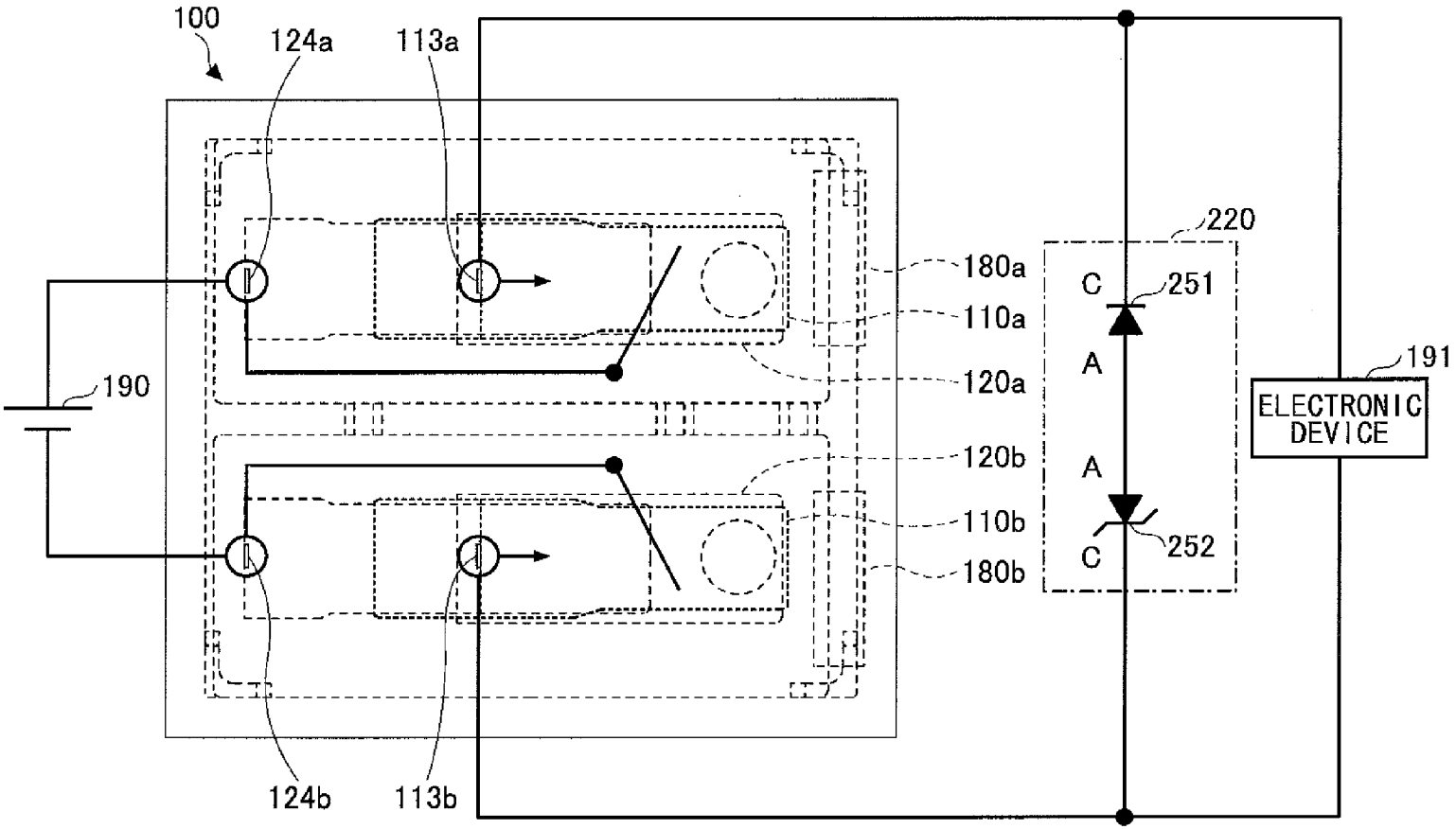
FIG. 20 is a schematic view for explaining another example of a switch device of the second embodiment.

FIG. 20 is a schematic view of another example of the switch device 100 of the second embodiment. FIG. 20 shows a bottom side of the switch device 100.

The counter-electromotive force suppression unit 220 of this example includes a diode 251 and a Zener diode 252 connected in series instead of the resistor 221 and the capacitor 222 shown in FIG. 17.

In this example, specifically, in the counter-electromotive force suppression unit 220, the anode of the diode 251 and the anode of the Zener diode 252 are connected so that the counter-electromotive force suppression unit 220 is electrically connected to the electronic device 191 in parallel. The cathode of the diode 251 is electrically connected to the fixed portion external terminal 113*a* and the cathode of the Zener diode 252 is electrically connected to the fixed portion external terminal 113*b*.

Other components not specifically explained in the second embodiment are similar to those of the first embodiment. Further, the switch device 100 of the second embodiment may be incorporated into the jack connector 10 explained in the first embodiment.

According to the above embodiments, a switch device, which can correspond to a power source of a voltage higher than that of the current commercial power source or a direct current power source, with high performance and reliability can be provided. Further, a connector, which can correspond to a power source of a voltage higher than that of the current commercial power source or a direct current power source and safely supply the electric power from the power source, with a high performance can be provided.

Although in the above embodiments, the jack connector 10 is explained as an example of a connector including the switch device 100, the switch device 100 may be incorporated in a plug connector.

Further, the plug connector 300 may be configured to be electrically connected to the power source side and the jack connector may be configured to be electrically connected to the electronic device side.

Further, the first movable portion 120*a* and the second movable portion 120*b* may be configured to be electrically connected to the electronic device side, and the first fixed portion 110*a* and the second fixed portion 110*b* may be configured to be electrically connected to the power source side.

In the above embodiments, the magnet unit is configured to include the first permanent magnet 180*a* and the second permanent magnet 180*b*. In other words, the first permanent magnet 180*a* and the second permanent magnet 180*b* are provided respectively for the first contacting portion 201*a* and the second contacting portion 201*b*. However, the first permanent magnet 180*a* and the second permanent magnet 180*b* may be formed to be a common magnet for the first contacting portion 201*a* and the second contacting portion 201*b*. It means that the magnet unit may include a single magnet commonly provided for the first contacting portion 201*a* and the second contacting portion 201*b*.

Although a preferred embodiment of the connector or the switch device has been specifically illustrated and described, it is to be understood that minor modifications may be made therein without departing from the sprit and scope of the invention as defined by the claims.

The present invention is not limited to the specifically disclosed embodiments, and variations and modifications may be made without departing from the scope of the present invention.

The present application is based on Japanese Priority Application No. 2011-176406 filed on Aug. 11, 2011, the entire contents of which are hereby incorporated herein by reference.

What is claimed is:

1. A switch device comprising:

a first contacting portion including a first fixed contacting portion and a first movable contacting portion configured to contact the first fixed contacting portion;

a second contacting portion including a second fixed contacting portion and a second movable contacting portion configured to contact the second fixed contacting portion;

a first electric arc voltage suppression unit configured to be electrically connected to the first fixed contacting portion and the first movable contacting portion for suppressing generation of an electric arc between the first fixed contacting portion and the first movable contacting portion; and a second electric arc voltage suppression unit configured to be electrically connected to the second fixed contacting portion and the second movable contacting portion for suppressing generation of an electric arc between the second fixed contacting portion and the second movable contacting portion.

2. The switch device according to claim 1, wherein the first electric arc voltage suppression unit includes a first resistor and a first capacitor connected in series, and the second electric arc voltage suppression unit includes a second resistor and a second capacitor connected in series.

3. The switch device according to claim 1, further comprising:

a magnet unit configured to generate magnetic fields between the first fixed contacting portion and the first movable contacting portion and between the second fixed contacting portion and the second movable contacting portion, respectively.

4. A connector for electrically connecting a power source and an electronic device, comprising:

the switch device according to claim 1; and a first fitting terminal and a second fitting terminal configured to be electrically connected to the first fixed contacting portion and the second fixed contacting portion or the first movable contacting portion and the second movable contacting portion, respectively, to be fitted with terminals of another connector.

5. The switch device according to claim 1, wherein the first fixed contacting portion and the second fixed contacting portion are configured to be electrically connected to one of a power source and an electronic device while the first movable contacting portion and the second movable contacting portion are configured to be electrically connected to the other of the power source and the electronic device.

6. A switch device connectable between an electronic device and a power source, the switch device comprising:

a first contacting portion including a first fixed contacting portion and a first movable contacting portion configured to contact the first fixed contacting portion;

a second contacting portion including a second fixed contacting portion and a second movable contacting portion configured to contact the second fixed contacting portion; and a counter-electromotive force suppression unit configured to be electrically connected to the electronic device in parallel for suppressing generation of counter-electromotive force by the electronic device when the electrical connection between the electronic device and the power source is broken.

7. The switch device according to claim 6, wherein the counter-electromotive force suppression unit includes a diode and a Zener diode connected in series where an anode of the diode and an anode of the Zener diode are connected with each other.

8. The switch device according to claim 6, further comprising:

a magnet unit configured to generate magnetic fields between the first fixed contacting portion and the first movable contacting portion and between the second fixed contacting portion and the second movable contacting portion, respectively.

9. A connector for electrically connecting a power source and an electronic device, comprising:

the switch device according to claim 6; and a first fitting terminal and a second fitting terminal configured to be electrically connected to the first fixed contacting portion and the second fixed contacting portion or the first movable contacting portion and the second movable contacting portion, respectively, to be fitted with terminals of another connector.

10. The switch device according to claim 6, wherein the first fixed contacting portion and the second fixed contacting portion are configured to be electrically connected to one of the power source and the electronic device while the first movable contacting portion and the second movable contacting portion are configured to be electrically connected to the other of the power source and the electronic device.

* * * * *